US010104953B2

(12) United States Patent
Fogueteiro

(10) Patent No.: US 10,104,953 B2
(45) Date of Patent: Oct. 23, 2018

(54) MECHANICAL COUPLING OF A COSMETIC PRODUCT CONTAINER

(71) Applicant: CHANEL PARFUMS BEAUTE, Neuilly-sur-Seine (FR)

(72) Inventor: Paulo Fogueteiro, Nogent sur Oise (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 15/500,750

(22) PCT Filed: Jul. 31, 2015

(86) PCT No.: PCT/FR2015/052125
§ 371 (c)(1),
(2) Date: Jan. 31, 2017

(87) PCT Pub. No.: WO2016/020609
PCT Pub. Date: Feb. 11, 2016

(65) Prior Publication Data

US 2017/0215555 A1 Aug. 3, 2017

(30) Foreign Application Priority Data

Aug. 4, 2014 (FR) ..... 14 57589

(51) Int. Cl.

| | |
|---|---|
| ***A46B 11/00*** | (2006.01) |
| ***A45D 40/26*** | (2006.01) |
| ***A45D 34/00*** | (2006.01) |
| ***A45D 40/00*** | (2006.01) |
| ***A45D 34/04*** | (2006.01) |
| ***A45D 40/06*** | (2006.01) |

(52) U.S. Cl.
CPC ..... *A45D 40/26* (2013.01); *A45D 34/00* (2013.01); *A45D 34/04* (2013.01); *A45D 40/00* (2013.01); *A45D 40/06* (2013.01); *A45D 40/264* (2013.01); *A46B 2200/1053* (2013.01)

(58) Field of Classification Search
CPC ..... A46B 2200/1053; A45D 40/264
USPC ..... 401/126, 127
See application file for complete search history.

(56) References Cited

U.S. PATENT DOCUMENTS 6,270,273 B1 8/2001 Ohba
8,287,199 B2 * 10/2012 Salciarini ..... A45D 34/046 401/109

(Continued)

FOREIGN PATENT DOCUMENTS

DE 74 33 846 U 4/1975
DE 20 2005 003 825 U1 7/2006

(Continued)

*Primary Examiner* — Jennifer C Chiang
(74) *Attorney, Agent, or Firm* — Greenblum & Bernstein, P.L.C.

(57) ABSTRACT

A container for a cosmetic product, including an outer part that includes a bottom and a side wall extending from the bottom, and an inner part that includes a bottom and a side wall extending from the bottom, the inner part being inserted and fastened in the outer part as a result of the bottom of the outer part including a bridge-type tongue and the bottom of the inner part including a claw, the claw engaging beneath the tongue, fastening the inner part inside the outer part.

12 Claims, 3 Drawing Sheets

(56) References Cited

U.S. PATENT DOCUMENTS

| | | | | |
|---|---|---|---|---|
| 8,287,201 | B2 * | 10/2012 | Salciarini | A45D 34/046 401/109 |
| 8,783,988 | B2 * | 7/2014 | Sanchez | A45D 34/04 401/109 |
| 2007/0110502 | A1 | 5/2007 | Salciarini et al. | |
| 2010/0290827 | A1 | 11/2010 | Komatsuda et al. | |
| 2011/0200382 | A1 | 8/2011 | Salciarini et al. | |
| 2012/0248006 | A1 | 10/2012 | Salciarini et al. | |

FOREIGN PATENT DOCUMENTS

| | | | |
|---|---|---|---|
| EP | 1 060 686 | A1 | 12/2000 |
| EP | 2 253 241 | A1 | 11/2010 |
| FR | 2 906 114 | A3 | 3/2008 |
| GB | 2 388 587 | A | 11/2003 |
| WO | WO-2006/120336 | A1 | 11/2006 |
| WO | WO-2010/043802 | A1 | 4/2010 |
| WO | WO-2011/077042 | A1 | 6/2011 |
| WO | WO-2016/020610 | A1 | 2/2016 |

* cited by examiner

MECHANICAL COUPLING OF A COSMETIC PRODUCT CONTAINER

BACKGROUND

1. Field of the Invention

The present invention concerns a container (or case) for a cosmetic or hygiene product.

More particularly, the invention concerns a container for a cosmetic or hygiene product, comprising an application member that is engaged, other than during application of the product, in a tubular member for storage and protection.

2. Background Information

Containers are known in which the tubular member, for example, comprises two parts joined to each other.

For this, the two parts are often coupled to each other using adhesive. Such a container is for example described in patent application WO2006120336, in which the container is used for lipstick.

Difficulties linked to the use of adhesive arise in particular when the two parts are produced from different materials, for example one from plastic and the other from metal.

In that case, it is difficult to define an adhesive that ensures good adhesion with the two different materials simultaneously.

It is then advantageous to be able to create a mechanical coupling, which enables better management of the mechanical strength properties over time and a simplified assembly method.

For example, international patent application WO2010043802 or international patent application WO2011077042 are known, the latter describing, in particular, a container (or casing) for lipstick of which the tubular member for storage and protection comprises a cap (or lid) and a cage engaged in the lower portion of the cap to constitute the bottom thereof and which is fastened to the cap by means of lateral staples.

This is advantageous for avoiding the loss in volume at the bottom of the tubular member for storage and protection, but the coupling of the cage to the cap requires the addition of additional members, such as staples. Furthermore, with the staples, residual play subsists.

SUMMARY

The present invention attenuates the aforementioned drawbacks at least in part, furthermore leading to other advantages.

To that end, according to a first aspect, there is provided a cosmetic product container comprising an outside part, which comprises a bottom and a lateral wall extending from the bottom, and an inside part, which comprises a bottom and a lateral wall extending from the bottom, the inside part being inserted and fastened in the outside part, wherein the bottom of the outside part comprises a tab in the form of a bridge and the bottom of the inside part comprises a claw, the claw being engaged under the tab, fastening the inside part in the outside part.

The inside part and the outside part are thus mechanically coupled to each other in a non-demountable way, that is to say that they can only be separated from each other with great difficulty, possibly by using tools, which would damage the parts.

It is furthermore very convenient to assemble two parts whatever the material constituting them. One may for example be of plastic, the other of metal.

Bulk linked to the coupling system between the two parts is also very small. Furthermore, there is a minimum volume lost, or even no volume lost, between the outside part and the inside part.

Each part here comprises a bottom and a wall that extends from one side of the bottom. The side of the bottom from which the wall extends thus defines an inside of the part. Outside of this is an outside of the part.

In an exemplary configuration, the lateral wall of the outside part is substantially cylindrical. It extends for example from the whole of a periphery of the bottom with a uniform cross section, which has substantially the same shape as the bottom. Furthermore, in an exemplary configuration, it is unpierced.

The lateral wall of the inside part is for example pierced in places. As a further example, the lateral wall of the inside part comprises one or more uprights. According to an exemplary embodiment, the bottom of the inside part is substantially square, and an upright extends from one corner of the bottom.

According to an advantageous example embodiment, the bottom of the outside part and the bottom of the inside part have the same shape. The bottom of the inside part is for example homothetically smaller than the bottom of the outside part.

Furthermore, it may be advantageous for an outside surface of the lateral wall of the inside part to be tangential to an inside surface of the lateral wall of the outside part.

According to an exemplary embodiment, the tab may be formed by press forming of a segment of the bottom of the outside part delimited by two parallel slots.

The outside part is for example of metal. The press forming of the bottom is thus particularly easy for forming the tab.

The tab may be produced by press forming in a finishing operation or by any other appropriate means.

For example, the tab comprises a median portion, in relief on an inside of the bottom of the outside part, and two linking arches, on opposite sides of the median portion, linking the median portion to the bottom of the outside part. According to an exemplary embodiment, the median portion is a portion that is substantially planar and parallel to the bottom of the outside part. This makes it possible to reduce the bulk of a tab while maximizing the possibilities of easy insertion of a claw under the tab.

According to a practical exemplary embodiment, the claw comprises a bevel configured to facilitate insertion of the claw under the tab.

According to a particular exemplary embodiment, the bottom of the inside part comprises at least one main opening passed through by at least a portion of the tab and the claw is formed on an edge of the main opening, extends within the main opening and is engaged under the portion of the tab that passes through the main opening. If the tab comprises a planar portion, the tab then extends beyond the bottom of the inside part as little as possible.

According to another particularly advantageous exemplary embodiment, the claw is formed within a thickness of the bottom of the inside part and forms a projecting step formation extending within the main opening from an edge of that opening.

This has the advantage of reducing as well as possible the bulk caused by the coupling between the outside part and the inside part.

For example, the claw comprises a bearing plane, configured to abut under a corresponding tab, and a bevel configured to facilitate insertion of the claw under the corresponding tab. In a possible case, the bearing plane is advantageously formed extending in line with a surface of the bottom on the inside of the inside part and extends in the main opening from an edge of that opening. As regards the bevel, this advantageously comprises a planar slanting surface linking an edge of a free end of the bearing plane to the edge of the main opening, or optionally to a surface of the bottom of the outside of the inside part.

In other words, the claw may for example be formed by a step formation in the contour of the main opening contained between a plane of the surface of the outside and a plane of the surface of the inside of the bottom of the inside part.

According to still another advantageous exemplary embodiment, the bottom of the inside part comprises at least one secondary opening defining between itself and the main opening a branch in the form of a rod and the claw is formed on the branch.

According to an exemplary embodiment, the inside part comprises two branches that define between them the main opening which is passed through by at least portion of a tab.

In other words, the bottom of the inside part comprises a second secondary opening that, with the main opening, defines a second branch.

According to an exemplary embodiment, the two branches are substantially parallel to each other. Furthermore, they are for example substantially parallel to the tab.

According to another practical example, the inside part comprises two claws formed on an edge of the main opening and each claw is engaged under the portion of the tab that passes through the main opening and from opposite sides of the tab.

In an exemplary embodiment, two claws face each other.

For example, one claw extends from each branch in the main opening so as to engage from opposite sides of the tab.

According to a particular exemplary embodiment, the bottom of the outside part comprises two tabs. The two tabs are for example substantially identical and parallel to each other.

In a possible case, the inside part comprises at least one claw engaged under each of the tabs, or even two claws per tab. It is then advantageous for the two claws of a tab to be engaged under the tab, from opposite sides of the tab. According to a particular exemplary embodiment, each claw is formed on a branch.

Thus, for example, the inside part comprises two pairs of branches, that is to say four branches in total.

This form of construction with four branches and four claws even better ensures a non-demountable assembly. This is because, to unhook the inside part, it would be necessary to move apart the four claws simultaneously from each other, which is then very difficult, or practically impossible, in particular without requiring various tools.

For example, the container comprises a spacer positioned between the bottom of the inside part and the bottom of the outside part that is configured to take up the play between the claw and the tab under which the claw is engaged.

Such a spacer is for example a stud or a blade spring. It is for example joined to an outside of the bottom of the inside part According to an advantageous example, if the inside part comprises a wall formed by three uprights disposed at three corners of the bottom of substantially square shape, the spacer is advantageously situated towards the corner of the bottom that has no upright, so as to take advantage of greater elasticity of the bottom in that zone.

According to another example, the container comprises two spacers that are disposed at two opposite points, for example on a diagonal of the bottom of the inside part if the latter is for example substantially square.

Thus, according to an advantageous exemplary embodiment, the bottom of the inside part is away from the bottom of the outside part by a distance substantially equal to the plays from manufacturing tolerance or from spacing caused by the spacer. In other words, without taking into consideration potential plays from manufacturing tolerance or from spacing caused by the spacer, the bottom of the inside part is substantially tangential to the bottom of the outside part.

According to an exemplary implementation, such a container is for example a container for a liquid or pasty product, for example a container for lip gloss, often called "gloss", or a container for mascara, or for instance a case for lip blush, and in particular a case for lipstick of which the stick is formed from a makeup product of which the color may be other than a shade of red or a pasty hygiene product, such as a lip balm, in particular for protecting the lips against external aggressions.

In a possible case, the container comprises an application member and a tubular member for storage and protection which comprises a sleeve and a cage, the sleeve forming the outside part and the cage forming the inside part.

The application member is sometimes called the mechanism.

Furthermore, the tubular body and the tubular member for storage and protection may or may not have a circular cross section.

Thus, for example, the inside part could be a simple member for internal lining of the outside part, as in patent application EP2253241 for example (see for example FIG. 13 illustrating the outside part 19 and the inside part 18). The same can apply for the closure or cap of a container. As a further example, the inside part could be a supply of cosmetic product, as illustrated in patent application FR2906114 or for instance EP1060686.

Or, according to another example, if the container is a lipstick, the application member comprises a base, a tubular body axially linked to the base and a support bearing a stick of lipstick configured to move axially in the tubular body by a relative pivoting movement between the tubular body and the base so as to cause the stick to project from or, on the contrary, to retract into, the tubular body, the base and the tubular body cooperating with the sleeve to enclose and protect the stick when the user does not need it.

BRIEF DESCRIPTION OF THE DRAWINGS

The invention, according to an exemplary embodiment, will be well understood and its advantages will be clearer on reading the following detailed description, given by way of illustrative example that is in no way limiting, with reference to the accompanying drawings in which.

DETAILED DESCRIPTION

Identical parts represented in the aforementioned Figures are identified by identical numerical references.

Figure 1:
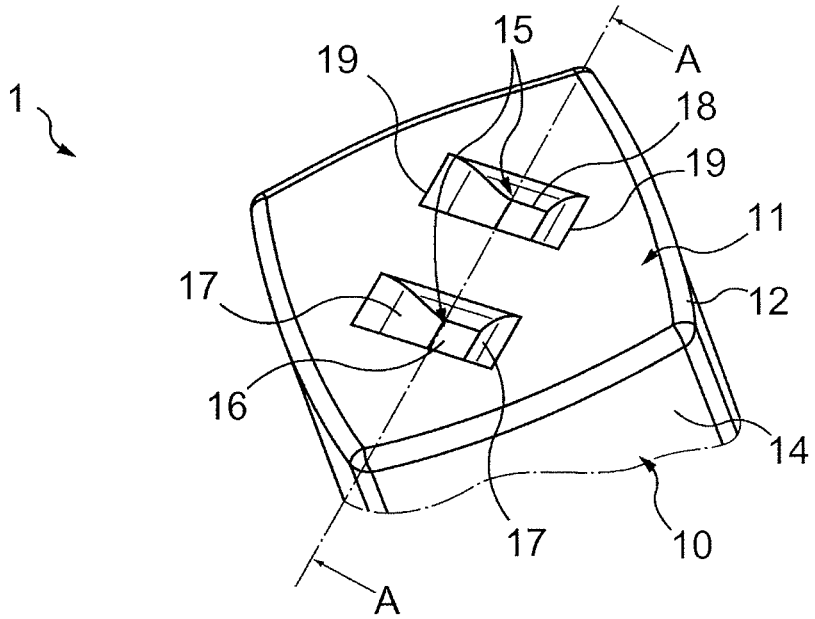
FIG. 1 presents a perspective view of an outside part according to an exemplary embodiment of the invention seen from the bottom.
Figure 2:
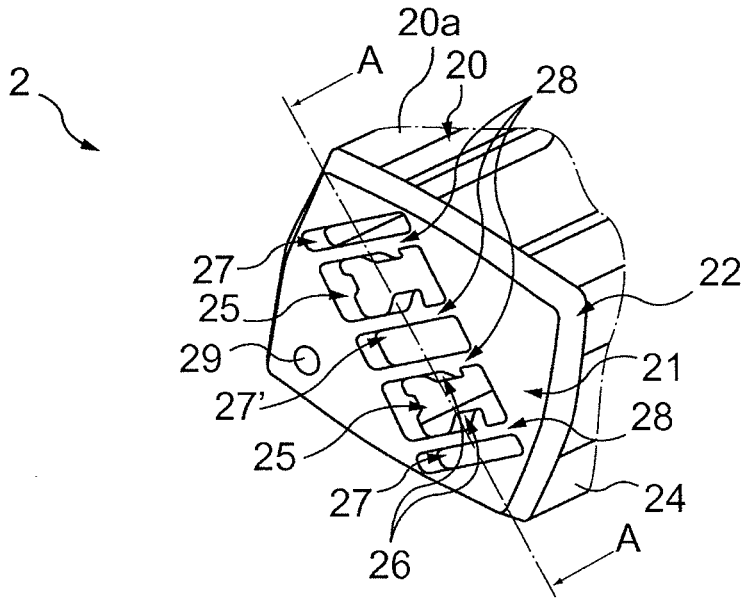
FIG. 2 presents a perspective view of an inside part according to an exemplary embodiment of the invention seen from the bottom.

In the context of the present description, the outside part 1 as represented in FIG. 1 is for example a sleeve of a cosmetic product container and an inside part 2 as represented in FIG. 2 is for example a cage. However, it could of course be any type of container or case of which the inside part is inserted and fastened inside the outside part.

In the exemplary embodiment of FIG. 1, the outside part 1 comprises a bottom 11 and a lateral wall 10 that extends from the bottom 11, substantially at a right angle.

One side of the bottom 11 from which extends the lateral wall 10 thus defines an inside of the outside part.

The lateral wall 10 comprises an inside surface 13 (visible in FIGS. 3 to 5), inward of the outside part 1, and an outside surface 14, which is an opposite surface to the inside surface 13, which extends here in line with a periphery 12 of the bottom 11. The outside surface 14 is for example a visible surface of a product. It is for example lacquered and black.

The lateral wall 10 substantially forms a right cylinder of uniform cross section equal to a shape defined by the periphery 12 of the bottom 11.

It is for example molded from plastic or metal, or is press-formed.

The bottom 11 here has a square shape domed outwards. It could however have a circular or other shape.

The bottom 11 here comprises two tabs 15, which are substantially identical and parallel to each other.

Each tab 15 here has a bridge shape formed in relief inside the outside part 1. In other words, each tab 15 here is a curved strip that defines a passage between itself and the bottom 11, on the inside of the bottom 11.

Here, each tab 15 comprises a median portion 16, in relief on an inside of the bottom 11 of the outside part 1, and two linking arches 17, on opposite sides of the median portion 16, linking the median portion 16 to the bottom 11 of the outside part 1. Furthermore, the median portion 16 is substantially planar here and parallel to the bottom 11 of the outside part 1.

Each tab 15 then comprises two free edges 18, which are substantially parallel to each other here, and two linking edges 19 that join the free edges 18 at each end.

The bottom 11 further comprises two rectangular cut-outs, with two long sides and two short sides, with each of the cut-outs being straddled by a tab 15 that meets the two short sides, so as to form the two linking edges 19.

The two rectangular cut-outs are side-by-side here in relation to their long sides and are disposed on a diagonal of the bottom 11.

For example, each tab 15 is formed by cutting out two slots, for example, that are parallel and of the same length, in the bottom 11 then by press-forming the portion of the bottom between the two slots. In this case, the slots would for example form the two long sides of the corresponding rectangle and the free edges 18 of the corresponding tab 15.

According to another form of construction, in particular when the outside part is of plastic material, the tabs are molded during injection molding.

According to an example not shown, the bottom 11 could comprise only one tab 15. However, the presence of two tabs enables the stability and the robustness of assembly with the inside part 2 to be improved.

FIG. 2 presents an inside part 2 which is for example a cage. Such a cage is for example described in patent application WO2010043802 for a mascara container, or WO2011077042 for a lipstick container.

The inside part 2 is for example molded in plastic or metal.

Here, the inside part 2 comprises a bottom 21 and a lateral wall 20 that extends from the bottom 21, substantially at a right angle.

One side of the bottom 21 from which extends the lateral wall 20 thus defines an inside of the inside part.

The bottom 21 here has a square shape domed outwards. It could however have a circular shape. In general, the bottom 21 has a similar shape to the cross section of the outside part 1 defined inside the lateral wall 10 so as to be able to be inserted therein while leaving a minimum of lateral play, that is to say between the lateral wall of the inside part and the lateral wall of the outside part.

The lateral wall 20 extends here in line with a periphery 22 of the bottom 21.

Purely by way of illustration, a wall 20 is illustrated in FIG. 2 which comprises three uprights 20*a* that are situated at three of the corners of the bottom 21 of substantially square shape, the fourth corner having no upright in the manner of the cage of application WO2011077042 (of course, this is not limiting and the inside part could have four uprights).

The lateral wall 20 comprises an inside surface 23 (visible in FIGS. 3 to 5), inwardly of the inside part 2, and an outside surface 24, which is an opposite surface to the inside surface 23, which extends in line with the periphery 22 of the bottom 21 and which is tangential to the inside surface 13 of the lateral wall 10 of the outside part 1 once the two parts have been assembled.

The bottom 21 here comprises two main openings 25, suitable for the bottom 11 of the outside part 1 which comprises two tabs 15. Of course, were the bottom 11 to comprise only one tab 15, a single opening 25 would be sufficient.

Each main opening 25 here is substantially rectangular with two long edges and two short edges of which the dimensions are substantially equal to those of the tabs 15, or even here of the corresponding rectangular cut-outs. The two main openings 25 are disposed beside each other, considering their long edges, and on a diagonal of the bottom 21, in accordance with the disposition of the tabs 15 of the outside part 1.

Each main opening 25 here comprises two claws 26. The two claws are positioned here on each of the two long edges of the corresponding main opening 25, substantially in their center so as to insert under the median portion 16 of the corresponding tab 15 when the outside part 1 and the inside part 2 are assembled.

Here, according to an advantageous exemplary embodiment of the present invention, each claw 26 is formed within a thickness of the bottom 21. This has the advantage of reducing as much as possible the bulk caused by the coupling between the outside part 1 and the inside part 2.

Figure 3:
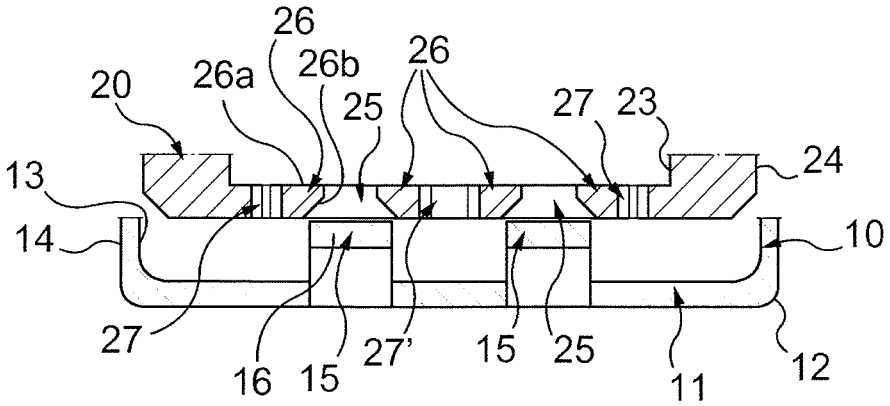
FIGS. 3 to 5 show, in a section view on line A-A represented in FIGS. 1 and 2, the main steps of coupling the inside part of FIG. 2 inserted into the outside part of FIG. 1.

As FIG. 3 shows better, each claw 26 comprises a bearing plane 26*a*, or surface, configured to abut under the corresponding tab 15, and a bevel 26*b* configured to facilitate insertion of the claw 26 under the corresponding tab 15.

The bearing plane 26*a* is formed here extending in line with the inside surface of the bottom 21, and extends, in the main opening 25, from an edge of that opening.

As regards the bevel 26*b*, this comprises a slanting planar surface and links an edge of a free end of the bearing plane

26*a* to the edge of the main opening, and more particularly as here, to the surface of the outside of the bottom 21.

In other words each claw 26 is formed by a step formation in the contour of the main opening 25 while being contained between a plane of the surface of the outside and a plane of the surface of the inside of the bottom 21.

To provide for the elasticity for the claws and in particular to enable them to spread apart on passage of a tab 15, the bottom 11 comprises secondary openings 27, 27' positioned behind each of the edges of a main opening 25 where a claw 26 is located.

In other words, here, a secondary opening 27 is disposed between a main opening 25 and a corner of the bottom 21, and an secondary opening 27', which is central, is disposed between the two main openings 25. There could of course be two secondary openings in place of the central secondary opening 27', but a single opening is still just as effective and easier to produce. A single central opening 27' is however, in a particular exemplary embodiment, wider in order to be able to leave sufficient retraction for each of the two claws 26 that have their backs turned to it when they retract to allow a tab 15 to pass, as is for example illustrated in FIG. 4.

In the present exemplary embodiment, there are thus two main openings 25 and three secondary openings 27, 27', between which are interposed the two main openings 25.

Furthermore, one edge of a secondary opening 27, 27' which is situated behind an edge of a main opening 25 on which is positioned a claw 26 is parallel to said edge of the main opening 25.

A main opening 25 and a secondary opening 27, 27' thus form between themselves a branch 28, which carries the claw 26.

Visually, it is thus possible to consider that the bottom 21 comprises a large opening here compartmentalized by four branches 28, which form two pairs of branches 28, with each of the pairs thus defining between its two branches 28 a main opening 25. An opening defined between a branch of one pair and a branch of another pair or an edge of the large opening is then a secondary opening 27, 27'.

The inside part 2 further comprises a spacer 29, which is for example here a stud formed projecting from an outside of the bottom 21. It is situated here substantially in the center of a triangle formed between a corner and the openings 25, 27, 27', that is to say a different corner from those between which the main openings 25 and the secondary openings 27, 27' form a succession.

In the case illustrated in FIG. 2 in which the cage comprises three uprights, the spacer 29 is situated towards the corner of the square which has no upright, so as to take advantage of the greater elasticity of the bottom 21 in that zone.

According to a variant not shown, the spacer may also be an elastic tab. This may also be situated in an unpierced zone of the bottom of the inside part, like the stud.

Figure 4:
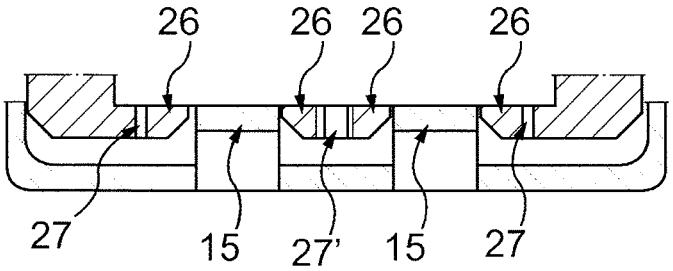
Figure 5:
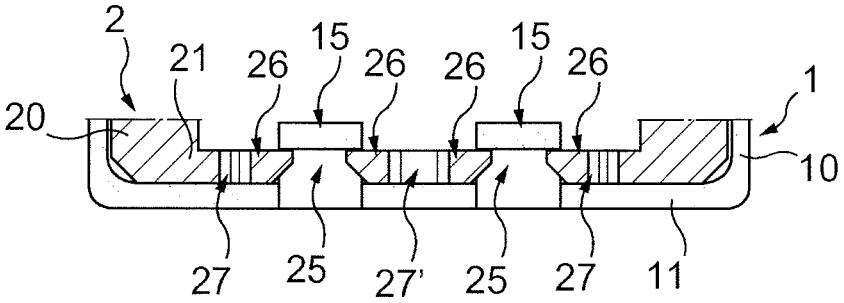

In this way, as FIGS. 3 to 5, show more particularly, when the inside part 2 is inserted into the outside part 1, each claw 26 comes first to abut against a tab 15.

A pressure applied to bring the bottom 21 of the inside part 2 and the bottom 11 of the outside part 1 closer together causes a spreading apart of the claws 26, and therefore of the branches 28 which carry them, by sliding of their bevel 26*b* on a free edge 18 of a tab 15, then the claw 26 engages under the tab 15, in particular here under the median portion 16. The spreading thus takes place substantially in a plane of the bottom until the claws pass under the tabs 15.

The branches then substantially resume their initial shape, or the claws their initial position, and these latter are thus engaged, in abutment, under the tabs 15, between the tabs 15 and the bottom 11 of the outside part 1. Two branches 28 then frame a tab 15.

To this is added the spacer 29, here the stud of increased thickness on the outside of the bottom 21, which takes up the plays from manufacturing tolerance. As the spacer 29 is situated on a relatively flexible zone of the bottom 21, on mounting, this zone flexes elastically and then tends to resume its initial shape. Such a spacer 29 thus makes it possible to minimize or even eliminate the plays that may exist between the claws 26 and the tabs 25.

FIG. 5 enables it to be noted that apart from a possible play from manufacturing tolerance and/or from spacing caused by the spacer 29, the bottom 21 of the inside part 2 is then tangential to the bottom 11 of the outside part 1.

According to an aesthetically advantageous option, the outside of the bottom 11 of the outside part 1 is ultimately provided with a label or any other means for concealing the cut-outs linked to the tabs 15.

The bottoms of the inside part and of the outside part may thus apply to any type of product, with for example the outside part being of metal and the inside part of plastic.

Figure 6:
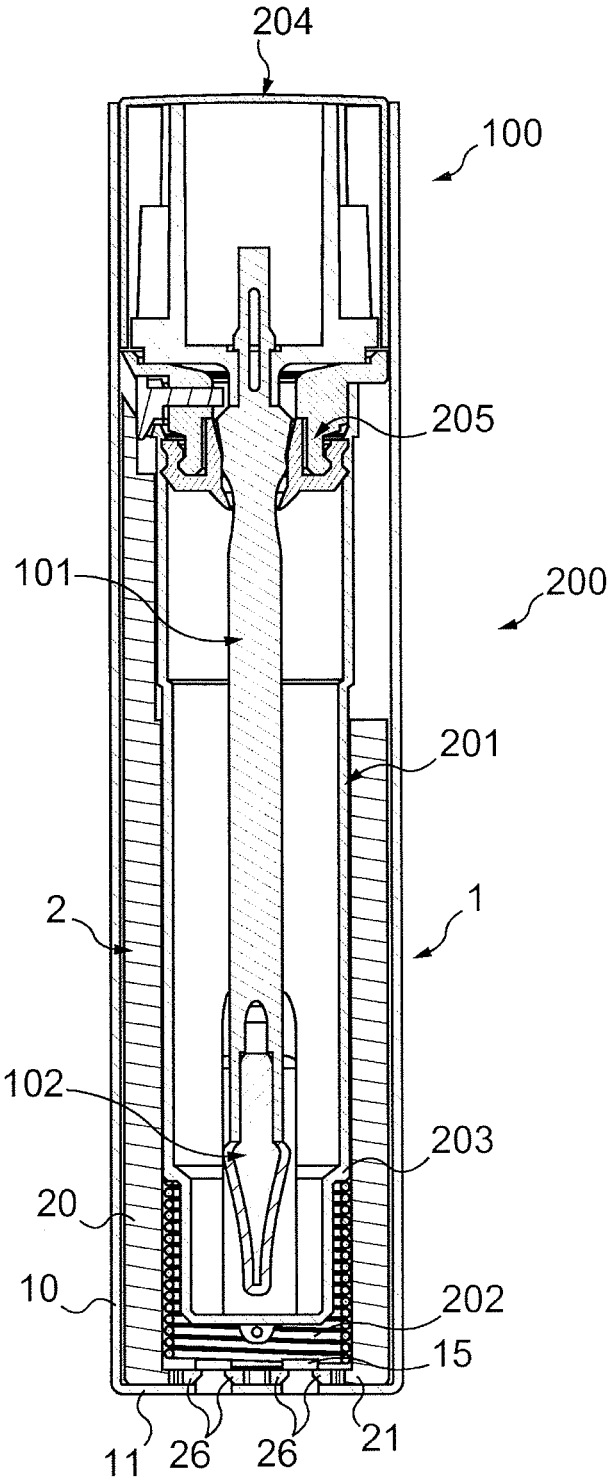
FIG. 6 shows an exemplary embodiment of a container for lip gloss comprising an inside part and an outside part fastened to each other according to an exemplary implementation of the present invention.

By way of an example of implementation, FIG. 6 represents a lip gloss container.

The lip gloss container comprises an application member 100 and a tubular member for storage and protection 200.

The tubular member for storage and protection 200 comprises a sleeve 1 and a cage 2, which respectively correspond to the outside part 1 and the inside part 2 already described.

The tubular member for storage and protection 200 further comprises a reservoir 201, which contains the fluid or pasty product, positioned within the cage 2 and configured to translate from top to bottom in the cage 2 over a predetermined travel, in particular by virtue of an action of an elastically compressible member 202, which here is a spring. The elastically compressible member 202 is held here, inside the cage 2, between the bottom 21 of the cage 2 and a shoulder 203 here formed on the outside peripheral surface of the reservoir 201.

In order to be able to use and apply the product, the application member 100 comprises a shaft 101 that at one end is terminated by an applicator 102 and at the other end is joined to a cap 204. When the container is closed, the application member 102 is then immersed in the product at the bottom of the reservoir 201.

A part 205, composed of one or more members, is disposed around an upper edge of the reservoir 201 and is fastened to the reservoir 201, for example by a push fit. It makes it possible to provide sealing of the reservoir when the latter is closed and to enable scraping of the shaft and/or wiping of the applicator 102 when the latter is extracted from the reservoir 201.

FIG. 6 thus shows that the presence of the tabs and their disposition as described above makes it possible to avoid any hindrance in the positioning and operating of an elastically compressible member 202 and/or of the reservoir 201 that may easily be mobile. The cage 2 is thus solidly fastened to the sleeve 1 without hindering the movements of the reservoir 201 or of any other member.

The present invention is limited neither to the preceding description nor to the appended drawings, but encompasses any variant form within the capability of the person skilled in the art.

The different features presented may be advantageously combined. Their presence in the description does not, indeed, exclude the possibility of combining them.

The terms "comprising" or "having" are to be interpreted here as "including" in the broad sense and not limitatively, exclusively or exhaustively. Similarly, the indefinite article "a" does not exclude the plural.

The invention claimed is:

1. A cosmetic product container comprising:
an outside part comprising:
a bottom; and
a lateral wall extending from the bottom; and
an inside part comprising:
a bottom; and
a lateral wall extending from the bottom wall of the inside part;
the inside part being positioned within and fastened inside of the outside part;
the bottom of the outside part comprising:
a tab in the form of a bridge, the tab comprising:
a median portion in relief on an inside of the bottom of the outside part;
two linking arches, on opposite sides of the median portion, linking the median portion to the bottom of the outside part;
the median portion being substantially planar and parallel to the bottom of the outside part; and
the bottom of the inside part comprising:
at least one claw engaged under the tab, fastening the inside part within the outside part.

2. A container according to claim 1, wherein:
the claw comprises a bevel configured to facilitate insertion of the claw under the tab.

3. A container according to claim 1, wherein:
the bottom of the inside part comprises at least one main opening, at least a portion of the tab passed through the main opening; and
the claw is formed on an edge of the main opening and extends within the main opening, the claw being engaged under the portion of the tab that is passed through the main opening.

4. A container according to claim 3, wherein:
the claw is formed within a thickness of the bottom of the inside part and forms a projecting step formation extending within the main opening from an edge of the main opening.

5. A container according to claim 3, wherein:
the bottom of the inside part comprises at least one secondary opening;
a branch positioned between the secondary opening and the main opening a branch; and
the claw is formed on the branch.

6. A container according to claim 3, wherein:
the at least one claw of the inside part comprises two claws formed on respective edges of the main opening; and
each of the two claws is engaged under the portion of the tab that is passed through the main opening and from opposite sides of the tab.

7. A container according to claim 1, further comprising:
a spacer positioned between the bottom of the inside part and the bottom of the outside part, the spacer being configured to take up play between the claw and the tab under which the claw is engaged.

8. A container according to claim 1, further comprising:
a cosmetic product application member; and
a tubular member for storage and protection of the application member, the tubular member comprising:
a sleeve forming the outside part; and
a cage forming the inside part.

9. A cosmetic product container comprising:
an outside part comprising:
a bottom; and
a lateral wall extending from the bottom; and
an inside part comprising:
a bottom; and
a lateral wall extending from the bottom wall of the inside part;
the inside part being positioned within and fastened inside of the outside part;
the bottom of the outside part comprising:
a tab in the form of a bridge; and
the bottom of the inside part comprising:
at least one claw engaged under the tab, fastening the inside part within the outside part;
at least one main opening, at least a portion of the tab passing through the main opening; and
the claw being formed on an edge of the main opening and extending within the main opening, the claw being engaged under the portion of the tab that is passed through the main opening.

10. A container according to claim 9, wherein:
the claw is formed within a thickness of the bottom of the inside part and forms a projecting step formation extending within the main opening from an edge of the main opening.

11. A container according to claim 9, wherein:
the bottom of the inside part comprises at least one secondary opening;
a branch positioned between the secondary opening and the main opening a branch; and
the claw is formed on the branch.

12. A container according to claim 9, wherein:
the at least one claw of the inside part comprises two claws formed on respective edges of the main opening; and
each of the two claws is engaged under the portion of the tab that is passed through the main opening and from opposite sides of the tab.

* * * * *